United States Patent [19]

Yasuhara

[11] 4,437,444

[45] Mar. 20, 1984

[54] FUEL INJECTION PUMP FOR A DIESEL ENGINE

[75] Inventor: Seishi Yasuhara, Yokosuka, Japan

[73] Assignee: Nissan Motor Company, Kanagawa, Japan

[21] Appl. No.: 331,328

[22] Filed: Dec. 16, 1981

[30] Foreign Application Priority Data

| | | | |
|---|---|---|---|
| Dec. 19, 1980 | [JP] | Japan | 55-180008 |
| Mar. 5, 1981 | [JP] | Japan | 56-31680 |
| Mar. 5, 1981 | [JP] | Japan | 56-31681 |

[51] Int. Cl.[3] ..... F02M 59/00

[52] U.S. Cl. ..... 123/458; 123/459

[58] Field of Search ..... 123/446, 458, 459, 460, 123/506, 198 D, 449, 387

[56] References Cited

U.S. PATENT DOCUMENTS

| | | | |
|---|---|---|---|
| 1,974,851 | 9/1934 | Hurst | 123/459 |
| 2,950,709 | 8/1960 | Bessiere | 123/446 |
| 3,301,245 | 1/1967 | Woodburn . | |
| 3,319,613 | 5/1967 | Begley et al. | 123/458 |
| 3,590,798 | 7/1971 | Goodwin . | |
| 4,073,275 | 2/1978 | Hofer et al. | 123/458 |
| 4,228,773 | 10/1980 | Stumpp et al. | 123/459 |
| 4,273,090 | 6/1981 | Hofer et al. | 123/506 |
| 4,351,283 | 9/1982 | Ament | 123/460 |

*Primary Examiner*—Charles J. Myhre
*Assistant Examiner*—Magdalen Moy
*Attorney, Agent, or Firm*—Lowe, King, Price & Becker

[57] ABSTRACT

A fuel injection pump for a diesel engine has a plunger pump. The plunger pump draws fuel from a fuel tank through a fuel passage to the engine. A safety device limits the flow rate of fuel supplied through the fuel passage to the plunger pump, and thus the engine, when the device is operated.

6 Claims, 21 Drawing Figures

FUEL INJECTION PUMP FOR A DIESEL ENGINE

BACKGROUND OF THE INVENTION

1. Field of the Invention

This invention relates to a fuel injection pump for a diesel engine, more particularly to a fuel injection pump equipped with a safety device for the fuel injection control.

2. Description of the Prior Art

Diesel engines are conventionally equipped with fuel injection pumps, which distribute and deliver fuel to the engine cylinders periodically with respect to the engine crankshaft rotation. The fuel injection pump also controls the amount of fuel injected into engine cylinders in response to the power required from the engine or the load on the engine. When the engine is employed to drive a vehicle, the fuel injection pump should be provided with a safety device which limits the rotational speed of the engine to prevent the vehicle from running away if a problem occurs in the control of the amount of fuel injected to the engine cylinders.

SUMMARY OF THE INVENTION

It is an object of the present invention to provide a fuel injection pump for a diesel engine, such as one used to drive a vehicle, wherein when a emergency switch is operated a safety device limits the amount of fuel supplied to the engine to a predetermined level at which the engine remains operative to drive the vehicle while preventing the vehicle from running away.

According to the present invention, a fuel injection pump for a diesel engine has a plunger pump. The plunger pump draws fuel from a fuel tank through a fuel passage to the engine. A safety device reduces the flow rate of fuel supplied through the fuel passage to the plunger pump, and thus to the engine, when the device is operated.

The above and other objects, features, and advantages of the present invention will be apparent from the following description of preferred and alternative embodiments thereof, taken in conjunction with the drawings.

DESCRIPTION OF THE PREFERRED EMBODIMENTS

Figure 1:
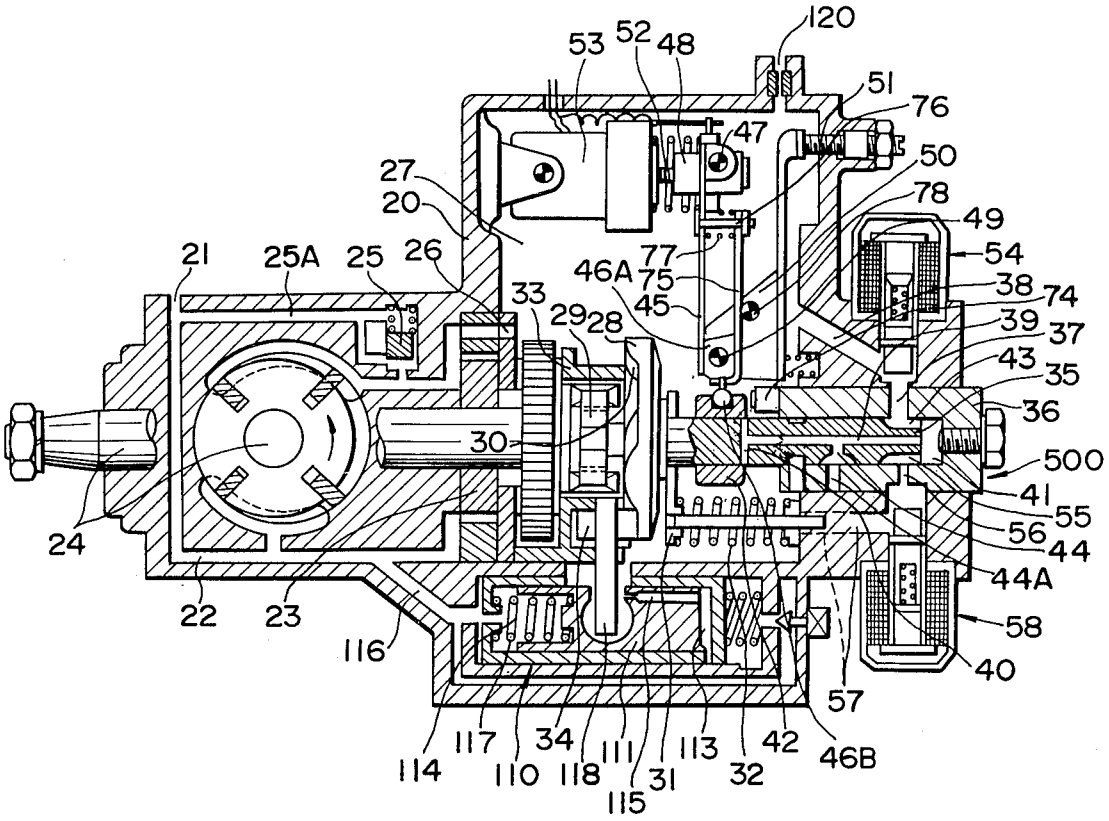
FIG. 1 is a diagrammatic sectional view of a fuel injection pump according to a first embodiment of the present invention.

With reference to FIG. 1, there is shown a fuel injection pump for a diesel engine driving a vehicle, according to a first embodiment of the present invention, which includes a housing 20 with a fuel inlet 21 and first fuel passage 22 communicating with each other. A rotary feed pump 23 is enclosed within the housing 20 and is driven by the engine to rotate at half the speed of, and in a constant phase relationship with, the engine crankshaft (not shown) through a drive shaft 24 coupled to the engine crankshaft. The feed pump 23 draws fuel admitted from the inlet 21 through the fuel passage 22 and supplies fuel to a chamber 27 through a second fuel passage 26. A fuel return passage 25A connects the outlet of the feed pump 23 with the first fuel passage 22. A relief valve 25 is arranged in the return passage 25A to determines the maximum pressure of fuel in the outlet of the feed pump 23. The feed pump 23 is shown rotated through 90° about a vertical axis, in addition to the normal section view thereof. A cam disc 28 is attached by keys 29 to the drive shaft in such a manner that it can easily move axially along the drive shaft but it can also rotate together with the drive shaft. The cam disc 28 has a plurality of cam faces 30, the number of which corresponds to the number of engine cylinders. The cam disc 28 is urged by a biasing plate 31 and plunger spring 32 toward a cylindrical roller casing 33 to be always engaged with rollers 34 on the casing 33. Since the roller casing 33 is supported so as to be rotatable without regard to the drive shaft, the cam disc 28 reciprocates axially by a predetermined amount of cam lift when each cam face 30 passes over the roller 34 as the cam disc 28 is rotated by the drive shaft 24 in synchronism with two rotation of the engine crankshaft.

A fuel supply plunger 35 is secured to the cam disc 28 so as to rotate with the drive shaft 24 and is fitted slidably into a cylinder 36 secured to the housing 20. The plunger 35 also axially tracks the axial motion of the cam disc 28. The cylinder 36 is provided with an intake port 37 which communicates with the chamber 27 through a third fuel passage 38. The intake port 37 acts as a part of the fuel passage 38. The plunger 35 is provided with a central axial passage 39 and a transverse spill port 40 communicating therewith to relieve the pressure from a high pressure chamber 41 formed by the end of the plunger 35 and the cylinder 36. A control sleeve 42 is slidably mounted on the plunger 35, controlling the opening of the spill port 40 to the chamber 27. As the control sleeve 42 moves away from the disc 28, the opening timing of the spill port 40 is retarded. The plunger 35 includes intake grooves 43, through which the intake port 37 and the high pressure chamber 41 communicate alternatingly according to the rotational phase of the plunger 35, and a distributor port 44 communicating with the central passage 39 and opening onto the periphery of the plunger. The distributor port 44 selectively communicates with any one of a plurality of radial outlet passages 44A formed in the cylinder 36. The outlet passages 44A lead to the corresponding engine cylinders (not shown) through corresponding delivery valves and injection nozzles (not shown).

The plunger 35 cooperates with the cylinder 36 to constitute a plunger pump 500. When the plunger 35 moves away from the high pressure chamber 41 while rotating, the intake groove 43 moves into communication with the intake port 37 to admit fuel into the high pressure chamber 41 from the chamber 27 through the fuel passage 38, thereby effecting a fuel intake stroke of the plunger pump 500. When the plunger 35 moves toward the high pressure chamber 41, the communication between the intake groove 43 and the intake port 37 is blocked and then the fuel in the high pressure chamber 41 is pressurized to enter the corresponding engine cylinder synchronously with two rotation of the engine crankshaft through the central axial passage 39, the distributor port 44, the outlet passage 44A, the delivery valve, and the injection nozzle. The fuel discharge stroke is thus effected in the plunger pump 500. Then, as soon as the spill port 40 is uncovered by the control sleeve 42, the fuel in the high pressure chamber 41 returns to the chamber 27 through the central axial passage 39 and the spill port 40, so that the fuel injection is ended. Thus, the fuel injection pump supplies fuel to each of the engine cylinders in turn once every two rotations of the engine crankshaft at a constant phase relationship.

A lever 45 is engaged at its base with a turning member 46A connected to the control sleeve 42 by means of a ball joint 46B. The free end of the lever 45 is pivotally connected at a pin 47 to a slider 48. The turning member 46A pivots about a pin 49, serving as the fulcrum of the lever 45, fixed to a plate 50 attached to the housing 20 by means of a rod 51 screwed into the housing 20. The slider 48 is mounted on and connected to a motor shaft 52 by means of threads so that it will move axially with respect to the motor shaft 52 as the shaft 52 rotates. A reversible motor 53 is located in the chamber 27 and is secured to the housing 20. When the motor 53 drives its shaft 52 in one direction, the slider 48 is moved axially and the lever 45 is pivoted, thereby displacing the control sleeve 42 away from the disc 28. In this case, the opening timing of the spill port 40 is retarded to increase the period during which the fuel is injected (in terms of crank angle) to increase the amount of fuel injected into the engine cylinders. When the motor 53 drives its shaft 52 reversely, the opening timing of the spill port 40 is in turn advanced to reduce the amount of fuel injected into the engine cylinders. Generally, the motor 53 is driven by a control unit (not shown in FIG. 1) to control the amount of fuel injected in response to the depression of the accelerator pedal (not shown) corresponding to the power required from the engine or the load on the engine.

The roller casing 33 is supported so as to be able to rotate. As the roller casing 33 with the rollers 34 is rotated in the direction opposite to the rotation of the cam disc 28, the timing at which the cam faces 30 pass the rollers 34 is relatively advanced. Therefore, this rotation of the roller casing 33 advances the fuel injection timing in terms of crank angle, since the fuel is injected as each cam face 30 passes over a roller 34. A timer assembly 110 is provided to vary the fuel injection timing according to the engine speed (RPM) by rotating the roller casing 33. The timer assembly 110 includes a timer cylinder 111 and a timer piston 112 disposed slidably within the cylinder 111 so as to define high-pressure and low-pressure chambers 113 and 114 in the cylinder 111 at opposite ends of the piston 112. The high-pressure chamber 113 communicates with the chamber 27 through a passage 115 in the piston 112 to introduce thereinto the pressure of fuel fed from the feed pump 23 to the chamber 27. The low-pressure chamber 114 communicates through a passage 116 with the fuel passage 22 leading to the inlet of the feed pump 23 to introduce thereinto the pressure of fuel fed to the feed pump 23. A timer spring 117 is arranged in the low-pressure chamber 114 to bias the piston 112 toward the high-pressure chamber 113. Thus the piston 112 moves axially according to the pressure difference between the chambers 113 and 114. The roller casing 33 is connected to the piston 112 by means of a driving pin 118 which is pivoted according to the axial movement of the piston 112. An increase in the rotational speed of the feed pump 23 or the engine speed (RPM) causes an increase in the pressure of fuel in the chamber 113. Thus, when the engine speed (RPM) increases, the piston 112 is forced away from the high-pressure chamber 113, thereby rotating the roller casing 33 in the direction opposite to that of the cam disc 28 rotation to advance relatively the fuel injection timing in terms of crank angle. For the sake of convenience, the timer assembly 110 is shown rotated through 90° about its vertical axis.

An overflow outlet 120 open to the chamber 27 is provided through the housing 20 wall to prevent excessive fuel pressure by releasing fuel in the chamber 27 to the low pressure side, such as a fuel tank (not shown in FIG. 1) communicating with the fuel inlet 21.

An electrically-driven valve 54 is interposed in the third fuel passage 38 to selectively cut off the supply of fuel to the high pressure chamber 41 through the passage 38. Normally, the fuel cut-off valve 54 is open to allow the fuel to enter the high pressure chamber 41 through the passage 38. The plunger 35 is provided with axially-extending auxiliary intake grooves 55 located diametrically opposite the corresponding intake grooves 43 and communicating with the high pressure chamber 41. The cylinder 36 is provided with a radially-extending auxiliary intake port 56 located diametrically opposite to the intake port 37. As the plunger 35 rotates while moving axially, the auxiliary port 56 selectively communicates with any one of the auxiliary grooves 55 and thus the high pressure chamber 41. The auxiliary port 56 communicates with the chamber 27 through an auxiliary fuel passage 57, partially shown by broken lines in FIG. 1 for the sake of convenience, formed in the housing 20 wall. The auxiliary port 56 acts as a part of the auxiliary fuel passage 57. An electrically-driven valve 58 is interposed in the auxiliary fuel passage 57 to selectively block the communication between the auxiliary passage 57 and the auxiliary port 56. The valve 58 is normally closed to cut off the communication. In this manner, the auxiliary passage 57 is connected at one end to the fuel passage 38 upstream of the cut-off valve 54 through the chamber 27 and at the other end to the auxiliary port 56 of the plunger pump 500.

Figure 2:
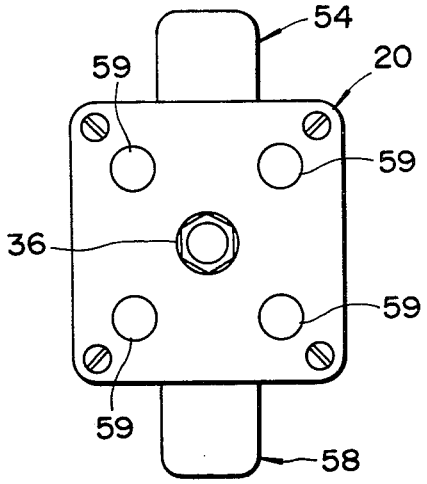
FIG. 2 is a diagrammatic, partial side view of the fuel injection pump of FIG. 1.

As illustrated in FIGS. 1 and 2, the valves 54 and 58 are designed in a manner similar to one another and are attached to the housing 20 in a diametrically opposite arrangement with respect to the cylinder 36. Reference numerals 59 indicate the aforementioned delivery valves spaced along the periphery of the cylinder 36 at 90° intervals in the case of a four-cylinder engine. The valves 54 and 58 are positioned between the delivery valves 59. The valves 54 and 58 may be spaced angularly at a 90° interval so as to be positioned between the delivery valves 59 of the four-cylinder engine.

Figure 3A:
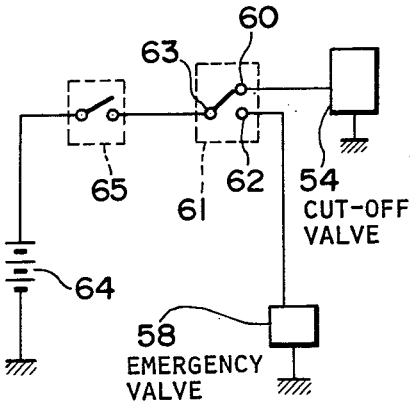
FIG. 3A is a schematic diagram of a circuit for operating the fuel supply cut-off valve and the emergency valve of FIG. 1.

As shown in FIG. 3A, the fuel cut-off valve 54 is electrically connected to a first stationary contact 60 of an emergency switch 61, while the emergency valve 58 is electrically connected to a second stationary contact 62 of the switch 61. The movable contact 63 of the switch 61, connected alternatably to the contact 60 or the contact 62, is connected to the positive terminal of a battery 64, serving as an electric power source, through an engine key switch 65. The negative terminal of the battery 64 is grounded. The valves 54 and 58 are also electrically grounded so as to form respective closable circuits with the battery 64. The valves 54 and 58 are of the type which switches from its closed to open position when energized.

Figure 4:
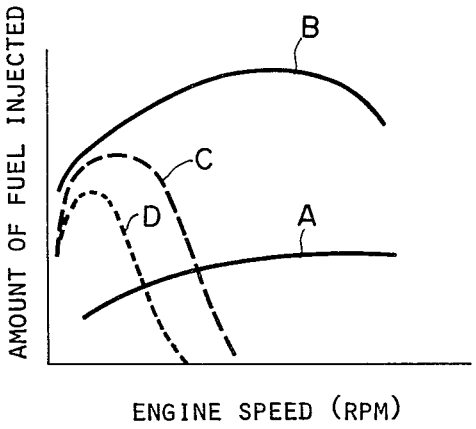
FIG. 4 is a graph of the relationship between the amount of fuel injected into the engine by the fuel injection pump of FIG. 1 and the engine speed (RPM)

The movable contact 63 normally contacts only the first stationary contact 60 to energize the valve 54 while de-energizing the valve 58, provided that the engine key switch 65 is closed. In this normal case, thus the valve 54 is open to allow the fuel to be supplied from the chamber 27 to the high pressure chamber 41 through the third fuel passage 38 while the valve 58 is closed to block the communication between the auxiliary passage 57 and the auxiliary port 56. The solid curves A and B in FIG. 4 show examples of normal characteristics of the fuel injection pump control. The curve A indicates the characteristics in the condition where the control sleeve 42 is farthest away from the high pressure chamber 41 to operate the engine in the idling condition. The curve B indicates the characteristics in the condition where the control sleeve 42 is closest to the chamber 41 to operate the engine in the full-power condition. According to these characteristics, the amount of fuel injected to the engine cylinders generally increases with the engine speed (RPM).

When the emergency switch 61 is operated to connect the movable contact 63 with the second stationary contact 62 instead of the first stationary contact 60 in case of an emergency, the valve 54 is de-energized to be closed while the valve 58 is energized to be open. Thus the valve 54 cuts off the supply of fuel from the chamber 27 to the high pressure chamber 41 through the fuel passage 38, and simultaneously the valve 58 establishes the communication between the auxiliary fuel supply passage 57 and the auxiliary intake port 56. Therefore, the fuel is supplied from the chamber 27 to the high pressure chamber 41 through the auxiliary passage 57, the auxiliary port 56, and any one of the auxiliary intake grooves 55 instead through the fuel passage 38. The fuel in the high pressure chamber 41 is in turn injected into the engine cylinders in a manner similar to that in the aforementioned normal conditions.

The auxiliary intake port 56 is of an effective cross-sectional area smaller than that of the intake port 37 so that the flow rate of fuel supplied into the high pressure chamber 27 in the emergency conditions will usually be less than that in the normal conditions to limit the amount of fuel injected into the engine cylinders. The broken curves C and D in FIG. 4 show examples of emergency characteristics of the fuel injection pump. According to these characteristics, the amount of fuel injected into the engine cylinders increases with the engine speed (RPM) along the curve C or D in the range where the engine speed (RPM) is below a certain predetermined value. On the other hand, the amount of fuel injected drops rapidly with the engine speed (RPM) along the curve C or D in the range where the engine speed (RPM) is above that predetermined value. This is because the smaller cross-sectional area of the auxiliary intake port 56 tends to cause a decrease in the amount of fuel supplied into the high pressure chamber 41 according to an increase in the engine speed (RPM). The cross-sectional area of the auxiliary intake port 56 is preferably set at an appropriate value at which the amount of fuel injected into the engine cylinders in the emergency condition is enough to maintain the operation of the engine while preventing the vehicle from running away. Thus, even in the emergency condition, the vehicle powered by the engine can be driven to a service station, for example, to be repaired or removed from a dangerous place, and a heater or an air conditioner mounted on the vehicle can be operated.

Figure 5:
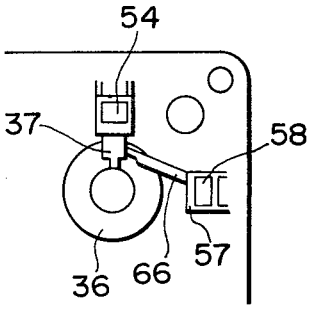
FIG. 5 is a diagrammatic view of an emergency intake port and its periphery according to an alternative embodiment of the auxiliary intake port of FIG. 1.

An alternative embodiment for the auxiliary intake port is shown in FIG. 5, wherein an auxiliary intake port 66 provided in the cylinder 36 opens at its one end to the intake port 37 downstream of the fuel cut-off valve 54 so as to make the auxiliary passage 57 bypass the valve 54 via the chamber 27 (see FIG. 1). The other end of the port 66 thus leads to the auxiliary passage 57 accommodating the emergency valve 58. In this embodiment, the auxiliary intake grooves 55 of FIG. 1 are unnecessary. In the emergency condition where the valve 54 is closed while the valve 58 is open, the fuel is supplied from the chamber 27 to the high pressure chamber 41 (see FIG. 1) through the auxiliary passage 57, the auxiliary port 66, the intake port 37, and any one of the intake grooves 43 (see FIG. 1). Since the auxiliary port 66 has a small cross-sectional area comparable to the auxiliary port 56 of FIG. 1, the flow rate of fuel supplied to the high pressure chamber 41 is limited in the emergency condition.

Figure 3B:
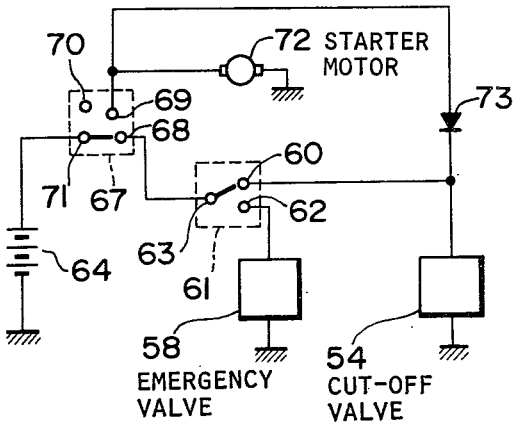
FIG. 3B is a schematic diagram of a circuit according to an alternative embodiment for the circuit of FIG. 3A.

An alternative embodiment for the valve operating circuit of FIG. 3A is shown in FIG. 3B, wherein valves 54 and 58, an emergency switch 61, an engine key switch 67, and a battery 64 are electrically connected in a manner similar to that of FIG. 3A. The engine key switch 67 has three stationary contacts 68, 69, and 70, and a movable contact 71 which can selectively contact any one of the stationary contacts 68, 69, and 70. The movable contact 71 is connected to the positive terminal of the battery 64, while the first stationary contact 68 is connected to the movable contact 63 of the emergency switch 61. One terminal of an engine starter motor 72 is connected to the second stationary contact 69 of the engine switch 67, the other terminal thereof being grounded. The anode of a diode 73 is also connected to the second contact 69, the cathode thereof being connected to the first stationary contact 60 of the emergency switch 61 and thus the valve 54. The third stationary contact 70 of the switch 67 is open.

This valve-operating circuit opens the fuel cut-off valve 54 even in the emergency condition during the engine starting, in order to supply enough fuel to the engine to assure the engine starting. When the movable contact 71 is connected to the second stationary contact 69 of the engine key switch 67 to start the engine, the engine starter motor 72 is energized and the valve 54 is also energized by the battery 64 through the diode 73 to be open, thereby supplying enough fuel to the high pressure chamber 41 (see FIG. 1) even in the emergency condition where the movable contact 63 is connected to the second stationary contact 62 of the emergency switch 61. Thus the fuel injection pump supplies sufficient fuel into the engine cylinders during engine starting. As soon as the movable contact 71 is switched to connect to the first stationary contact 68 of the engine switch 67, the motor 72 is de-energized and the valve 54 is also de-energized to be closed in the emergency condition while the emergency valve 58 is switched from its closed state to the open state.

Returning to FIG. 1, an electromagnet 74 may be provided for dealing with the problem in which the motor 53 is forcedly stopped. The electromagnet 74 is attached to the end of the cylinder 36 so as to be positioned between the cylinder 36 and the control sleeve 42. The electromagnet 74 is electrically connected in parallel with the emergency valve 58. The control sleeve 42 is made of magnetic material. When the emergency switch 61 (see FIG. 3A) is switched to energize the emergency valve 58 instead of the fuel cut-off valve 54 (see FIG. 3A), the electromagnet 74 is also energized, thereby attracting the control sleeve 42 in the direction of increasing the amount of fuel injected into the engine cylinders during each discharge stroke of the plunger pump 500, even though the motor 53 has stopped. Even when the motor 53 is forcedly stopped at a position where the amount of fuel injected into the engine cylinders may be zero or extremely small, the fuel injection pump thus can supply sufficient fuel to the cylinders to maintain the operation of the engine while preventing the engine from running away, by turning the emergency switch 61. An auxiliary lever 75 extending parallel to the lever 45 is fixed at its base to the turning member 46A. A pin 76 provided with heads at its opposite ends passes through the free ends of the auxiliary lever 75 and the lever 45 so that its heads are located outside each of the levers 45 and 75. A spring 77 is provided between the levers 45 and 75, on the periphery of the pin 76 so as to bias and abut the levers 45 and 75 against the respective pin heads. The auxiliary lever 75 also abuts against a pin 78 fixed to the plate 50. In response to a force overcoming the force of the spring 77, the auxiliary lever 75 pivots, irrespective of the position of the slider 48, against the spring 77 to displace the control sleeve 42 in the direction of increasing the amount of fuel supplied to the engine. Thus the auxiliary lever 75 allows the control sleeve 42 to move toward the electromagnet 74 when the electromagnet 74 is energized, provided that the force of the electromagnet 74 exerted on the auxiliary lever 75 is preset to overcome the force of the spring 77.

Figure 6:
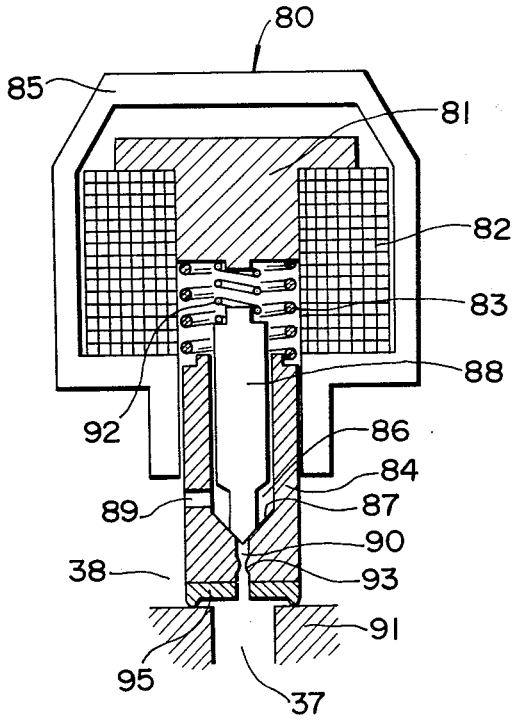
FIG. 6 is a diagrammatic sectional view of a pertinent portion of a second embodiment according to the present invention.

The essential portion of a second embodiment of the present invention is shown in FIG. 6, designed in a manner similar to the foregoing first embodiment except for the following change. A fuel cut-off valve 80, acting as an emergency valve, located in the fuel passage 38 leading to the intake port 37 has an iron core 81, a coil 82 for magnetizing the core 81, a spring 83, and a valve member 84 all enclosed in a cover 85. The spring 83 is provided between the core 81 and the valve member 84 so as to bias the valve member 84. When the coil 82 is de-energized or energized to a relatively small extent, the valve member 84 abuts against a wall 91 including the intake port 37 to block the communication between the intake port 37 and the fuel passage 38. The valve member 84 is provided with a bore 86 having a conical bottom 87 and accommodating a needle valve 88 made of magnetic material. The valve member 84 is also provided with an inlet port 89 connecting the bore 86 and the fuel passage 38, and an outlet port 90 connecting the bore 86 and the intake port 37 when the valve member 84 is seated on the wall 91 including the intake port 37. Normally, the needle valve 88 is abutted against the valve member 84 by the force of a spring 92 provided between the core 81 and the needle valve 88, so as to block the communication between the bore 86 and the intake port 37. The force of the spring 92 is sufficiently weaker than that of the spring 83 so that even relatively weak energization of the coil 82 will cause the needle valve 88 to move toward the iron core 81.

The outlet port 90 has a restriction or an orifice 93 restricting the rate of fuel flow through the outlet port 90. The restriction 93 is separated from the valve seat 94 for the needle valve 88 so as to be protected from deformation by impact with the needle valve 88. The bottom of the valve member 84 is covered with an elastic material 95, which directly abuts against the wall 91 to prevent fluid leakage between the fuel passage 38 and the intake port 37 when both the needle valve 88 and the valve member 84 are closed. The auxiliary fuel passage 57, the emergency valve 58, the auxiliary intake port 56, and the auxiliary intake grooves 55 (see FIG. 1) can be eliminated in this embodiment.

The distance from the iron core 81 and the valve member 84 or the needle valve 88, and the force of the spring 83 or 92 are preset at appropriate values to achieve the operation as follows: When the coil 82 is deenergized, both the valve member 84 and the needle valve 88 are closed; when the coil 82 is energized to a relatively small extent, only the needle valve 88 is open; when the coil is energized to a relatively great extent, both are open.

Figure 7A:
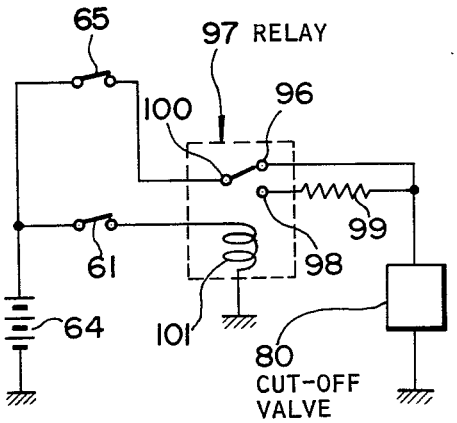
FIG. 7A is a schematic diagram of a circuit for operating the emergency valve of FIG. 6.

As illustrated in FIG. 7A, the fuel cut-off valve 80 is electrically connected at one terminal to a first stationary contact 96 of a relay 97 and also to a second stationary contact 98 of the relay through a resistor 99, the other terminal of the valve 80 being grounded. A movable contact 100 of the relay 97 selectively contacts the stationary contact 96 or 98 in one direction and leads to the positive terminal of a battery 64 through an engine key switch 65 in the other. The negative terminal of the battery 64 is grounded. A control winding 101 of the relay 97 is connected across the battery 64 through an emergency switch 61 of the on-off type. When the control winding 101 is energized, the movable contact 100 is forceably displaced from the first stationary contact 96 and contacts the second stationary contact 98.

In the normal conditions where the emergency switch 61 is open to de-energize the control winding 101 of the relay 97, the valve 80 is energized to a relatively great extent to open the valve member 84 so as to allow the fuel to pass therethrough, provided that the engine switch 65 is closed. When the emergency switch 61 is then closed, the control winding 101 is energized to connect the movable contact 100 with the second stationary contact 98 instead of the first stationary contact 96. Therefore the valve 80 is energized to a relatively small extent to open the needle valve 88 while closing the valve member 84, thereby passing the fuel from the fuel passage 38 to the intake port 37 only through the inlet port 89, the bore 86, the outlet port 90. The flow rate of fuel supplied to the plunger pump and thus the amount of fuel injected into the engine cylinders during each discharge stroke of the plunger pump 500 is restricted by the orifice 93 to a preset value at which the engine remains operating while preventing the vehicle from running away. The voltage of the battery 64 and the resistance of the resister 99 are set at respective values such that the voltage applied to the valve 80 will be, for example, 12 V (volts) in the normal conditions and 5 V (volts) in the emergency condition.

Figure 7B:
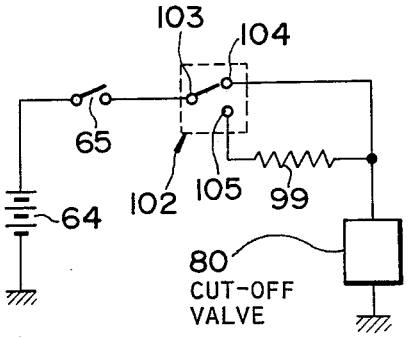
FIG. 7B is a schematic diagram of an alternative embodiment for the circuit of FIG. 7A.

An alternative embodiment for the operating circuit of the valve 80 is shown in FIG. 7B wherein an emergency switch 102 has a movable contact 103 which selectably contacts either a first stationary contact 104 or a second stationary contact 105. One terminal of the valve 80 is connected to the first contact 104 and parallelly to the second contact 105 through the resistor 99, the other terminal of the valve 80 being grounded. The movable contact 103 is connected to the positive terminal of the battery 64 through the engine key switch 65. The negative terminal of the battery 64 is grounded. When the movable contact 103 connects with the first stationary contact 104, a relatively large voltage is applied across the valve 80 to open both the valve member 84 and the needle valve 88 (see FIG. 6) in a way similar to the previous embodiment of FIGS. 6 and 7A. When the emergency switch 102 is turned to connect the movable contact 103 to the second stationary contact 105 instead of the first stationary contact 104, a relatively small voltage is applied across the valve 80 to open only the needle valve 88 (see FIG. 6) in a manner similar to the previous embodiment.

Figure 8:
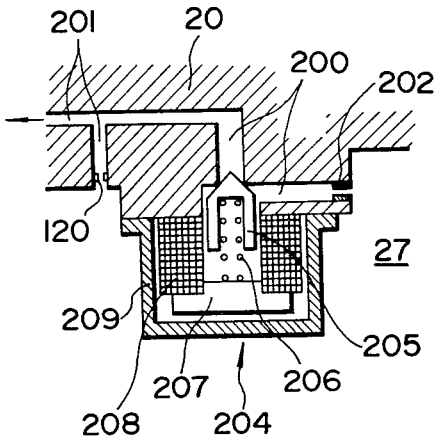
FIG. 8 is a diagrammatic sectional view of a pertinent portion of a third embodiment according to the present invention.

The essential portion of a third embodiment of the present invention is shown in FIG. 8, designed in a manner similar to the previous first embodiment except for the following arrangement. The auxiliary fuel passage 57, the emergency valve 58, the auxiliary intake port 56, and the auxiliary intake grooves 55 (see FIG. 1) can be eliminated. The housing 20 wall has therein a fuel return passage 200 branching from an overflow passage 201 and opening into the chamber 27 through a restriction or an orifice 202. The overflow passage 201 leads in one direction to the overflow outlet 120 (see FIG. 1) and in the other direction to a fuel tank 203 (see FIG. 12). The fuel return passage 200 is thus connected at one end to the fuel passage 38 (see FIG. 1) downstream of the feed pump 23 (see FIG. 1) through the chamber 27 and at the other end to the fuel tank.

An emergency solenoid or electrically driven valve 204 is interposed in the fuel return passage 200 downstream of the orifice 202 but upstream of the branching point of the passage 200. The emergency valve 204 includes a magnetic valve member 205 located in the fuel return passage 200, a spring 206 urging the valve member 205 in the direction of closing the valve member 205, an iron core 207, and a coil 208 for magnetizing the core 207. When the coil 208 is energized, the core 207 is magnetized to attract the valve member 205 against the force of the spring 206 in the direction of opening the valve member 205. Thus, when energized, the emergency valve 204 opens the fuel return passage 200. On the other hand, when de-energized, the emergency valve 204 closes the passage 200. The emergency valve 204 prevents fuel entrance thereinto by use of sealing members (not shown) and a cover 209 enclosing the valve member 205, the spring 206, the core 207, and the coil 208 along with the housing 20 wall. Although the emergency valve 204 is located in the chamber 27 in this case, it may be positioned outside the chamber 27 in order to prevent the fluid entrance.

Figure 9:
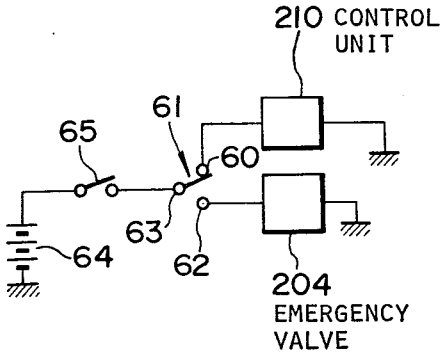
FIG. 9 is a schematic diagram of a circuit for operating the emergency valve of FIG. 8.

As illustrated in FIG. 9, the emergency valve 204 is electrically connected at one terminal to the second stationary contact 62 of the emergency switch 61 and is grounded at other terminal. A control unit 210 has one terminal connected to the first stationary contact 60 of the switch 61 and the other terminal being grounded. The movable contact 63 of the switch 61 ably contacting the first contact 60 or the second contact 62 leads to the positive terminal of the battery 64 via the engine key switch 65 in a similar way to that shown in FIG. 3A. The negative terminal of the battery 64 is grounded. The control unit 210 drives the motor 53 (see FIG. 1) in response to the power required from the engine so that the amount of fuel injected into the engine cylinders will increase with the power required from the engine. In the emergency condition where, for example, the control unit 210 is out of order, the fuel supply cut-off valve 54 (see FIG. 1) is so designed as to remain open to allow fuel to be supplied to the engine.

Figure 10:
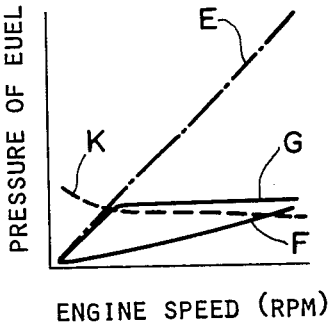
FIG. 10 is a graph of the relationship between the pressure in the chamber within the fuel injection pump of the previous third embodiment and the engine speed (RPM)
Figure 11:
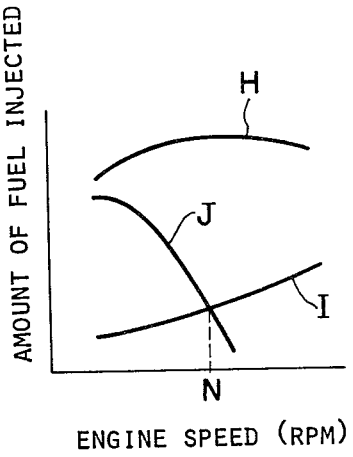
FIG. 11 is a graph of the relationship between the amount of fuel supplied to the engine in each discharge stroke of the plunger pump within the fuel injection pump of the previous third embodiment and the engine speed (RPM)

Under normal conditions, the emergency switch 61 connects its movable contact 63 with its first stationary contact 60 to supply electric energy from the battery 64 to the control unit 210, provided that the engine switch 65 is closed. Thus the control unit 210 normally operates the motor 53. On the other hand, the emergency valve 204 is de-energized to close the fuel return passage 200. Therefore, the fuel in the chamber 27 overflows only through the overflow outlet 120, so that the pressure of fuel in the chamber 27 is approximately proportional to the engine speed (RPM) or the rotational speed of the feed pump 23 supplying fuel to the chamber 27, as shown by the curve E, for example, in FIG. 10. This proportional relationship allows the amount of fuel supplied into the high pressure chamber 41 in each intake stroke of the plunger pump, namely the amount of fuel injected into the engine cylinders during each discharge stroke of the plunger pump, to remain roughly constant or slightly increase with the engine speed (RPM) as shown by the curves H and I in FIG. 11, although the period of the intake stroke of the plunger 35 decreases with its rotational speed or the engine speed (RPM). The curve H corresponds to the maximum fuel injection characteristics or the full-power condition of the engine, while the curve I corresponds to the minimum fuel injection characteristics or the idling condition of the engine.

When the emergency switch 61 is turned to connect its movable contact 63 with the second stationary contact 62 in the emergency condition where, for example, a problem occurs in the control system of the motor 53, the control unit 210 is suspended and the emergency valve 204 is energized to open the fuel return passage 200. Thus, the fuel in the chamber 27 returns to the fuel tank through the fuel return passage 200 in addition to the overflow outlet 120, so that the pressure of fuel in the chamber 27 is reduced to a great extent. In this case, the pressure of fuel in the chamber 27 does not match increase in the engine speed (RPM) of the rotational speed of the feed pump 23 as shown by the curve F in FIG. 10. As a result, the amount of fuel supplied into the high pressure chamber 41 (see FIG. 1) in each intake stroke of the plunger pump decreases with the engine speed (RPM). This provides a rapid, inversely-proportional relation of the amount of fuel injected into the engine cylinders during each discharge stroke of the plunger pump to increase in the engine speed (RPM), as shown by the curve J in FIG. 11. Therefore, when engine speed (RPM) is maintained below the value N in FIG. 11 defined by the intersection of the curves I and J, the engine is supplied with a amount of fuel similar to that of normal conditions in this relatively low speed region. Thus, even when the engine control malfunctions, the engine can be kept operating at a preset power or speed above the minimum value at which the vehicle can be started while preventing the vehicle from running away, by turning the emergency switch 61. This preset power or speed of the engine depends on the cross-sectional area of the orifice 202, which determines the rate of fuel flow through the fuel return passage 200.

Figure 12:
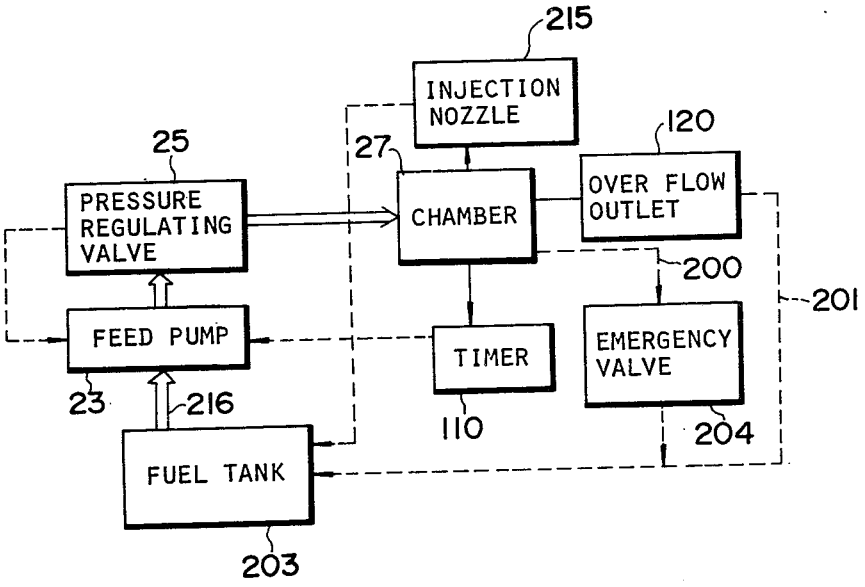
FIG. 12 is a block diagram of fuel flow in the previous third embodiment.

A diagram of fuel flow in this third embodiment is shown in FIG. 12, wherein the fuel in the tank 203 is drawn through a fourth fuel passage 216 by the feed pump 23 to be supplied into the chamber 27 through the relief valve 25. A portion of the fuel may be back into the feed pump 23 through the valve 25 to limit the pressure of fuel supplied into the chamber 27. A portion of the fuel in the chamber 27 may return to the fuel tank 203 through the overflow outlet 120 and the passage 201, and also through the fuel return passage 200 and the emergency valve 204 when the valve 204 unblocks the passage 200. A portion of the fuel in the chamber 27 enters the timer assembly 110, while the pressure of fuel in the inlet of the feed pump 23 is applied to the assembly 110. A portion of fuel in the chamber 27 is also supplied to the fuel injection nozzles 215, and the portion not injected into the engine cylinders is returned to the fuel tank 203.

Figure 13:
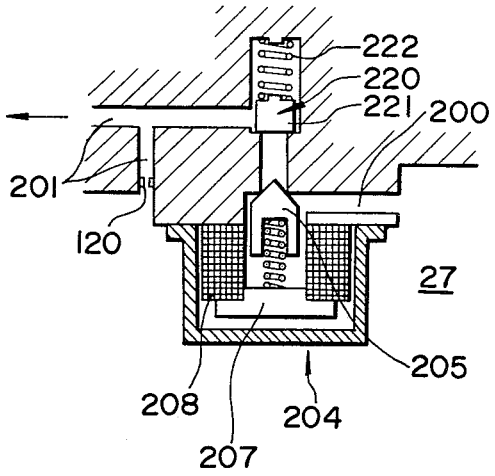
FIG. 13 is a diagrammatic sectional view of a pertinent portion of a fourth embodiment according to the present invention.

The essential portion of a fourth embodiment of the present invention is shown in FIG. 13, designed in a manner similar to the previous third embodiment except for the following arrangement. A regulating valve 220 is interposed in the fuel return passage 200 downstream of the emergency valve 204 but upstream of the branched point of the passage 200. The orifice 202 shown in FIG. 11 can be eliminated. The regulating valve 220 has a valve member 221 arranged in the fuel return passage 200 so as to open or close the same, and a spring 222 urging the valve member 221 in the direction of closing the passage 200. When the emergency valve 204 is open and the pressure in the chamber 27 applied to the valve member 220 overcomes the force of the spring 222, the valve member 221 is moved to open the fuel return passage 200 to a certain extent depending on the pressure, thereby returning the fuel in the chamber 27 to the fuel tank through the passage 200 in addition to the overflow outlet 120. Thus the pressure of fuel in the chamber 27 is regulated at an approximately constant value irrespective of the engine speed (RPM) in the relatively high-speed region as shown by the curve G in FIG. 10. On the other hand, the amount of fuel injected into the engine cylinders in each discharge stroke of the plunger pump decreases rapidly with increases in the engine speed (RPM) in a function similar to the curve J in FIG. 11.

Figure 14:
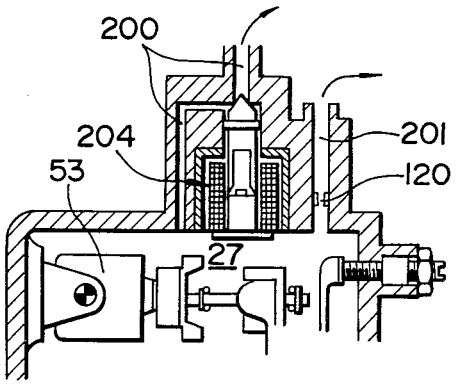
FIG. 14 is a diagrammatic sectional view of a pertinent portion of a fifth embodiment according to the present invention.

The essential portion of a fifth embodiment of the present invention is shown in FIG. 14, designed in a manner similar to that of the previous fourth embodiment except for the following arrangement. The fuel return passage 200 and the overflow passage 201 are independent of each other. The fuel return passage 200 is connected at one end to the inlet 21 leading to the feed pump 23 (see FIG. 1) and thus upstream of the pump 23, while the overflow passage 201 is connected at one end to the fuel tank 203 (see FIG. 12). Since the feed pump 23 directly facilitates fuel flow through the fuel return passage 200, the pressure of fuel in the chamber 27 can be further reduced as compared to the previous fourth embodiment when the emergency valve 204 is open. It should be noted that the overflow passage 201 may be eliminated and the emergency valve 204 may be tailored so as to be switched from a small to a large opening degree position when energized.

Figure 15:
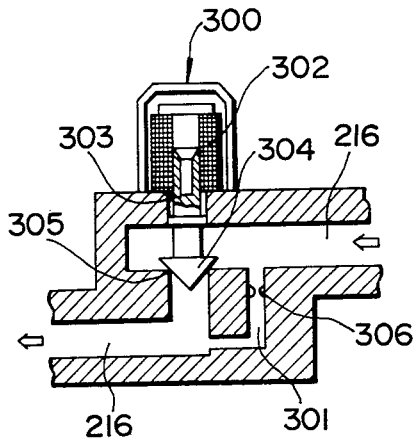
FIG. 15 is a diagrammatic sectional view of a pertinent portion of a sixth embodiment according to the present invention.

The essential portion of a sixth embodiment of the present invention is shown in FIG. 15, designed in a manner similar to that of the previous third embodiment except for the following design change. The fuel return passage 200 and the emergency valve 204 of FIG. 8 can be eliminated. An emergency on-off solenoid or electrically driven valve 300 is interposed in a fourth fuel passage 216 (see FIG. 12) through which the feed pump 23 draws fuel from the tank 203 (see FIG. 12). An auxiliary passage 301 is connected at either end to the fuel passage 216 in order to bypass the emergency valve 300. When de-energized, the valve 300 closes the fuel passage 216 to pass fuel only through the auxiliary passage 301.

The emergency valve 300 has a solenoid 302, a slidable magnetic member 303, and a cone-shaped valve member 304 attached to the end of the magnetic member 303. The valve member 304 is abutted against its annular seat 305 by a spring (not designated) in its rest position to close the fuel passage 216. When energized, the solenoid 302 attracts the magnetic member 303 together with the valve member 304 against the spring to disconnect the valve member 304 from its seat 305, thereby opening the fuel passage 216. A restriction or an orifice 306 is provided in the auxiliary passage 301 to limit the rate of fuel flow through the auxiliary passage 301 when the emergency valve 300 closes the fuel passage 216. The sum of the cross-sectional areas of the restriction 306 and the fuel passage 216 at the emergency valve 300 is set at a value approximately equal to that of the fuel passage 216 of FIG. 12.

Figure 16:
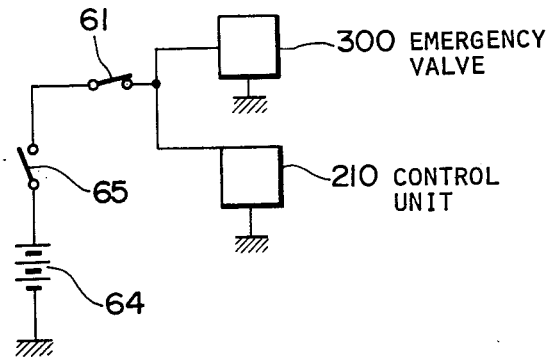
FIG. 16 is a schematic diagram of a circuit for operating the emergency valve of FIG. 15.

As shown in FIG. 16, the emergency valve 300 is connected across a battery 64 through an on-off emergency switch 61 and an engine key switch 65. A control unit 210 is connected in parallel with the emergency valve 300. In the emergency condition where, for example, the control unit 210 is out of order, the fuel supply cut-off valve 54 (see FIG. 1) is so designed as to remain open to allow fuel to be supplied to the engine.

Under normal conditions, the emergency switch 61 is closed to supply electric energy from the battery 64 to the emergency valve 300 and the control unit 210, provided that the engine switch 65 is closed. Thus, the emergency valve 300 opens the fuel passage 216 to supply fuel from the fuel tank 203 to the feed pump 23 through the fuel passage 216 in addition to the auxiliary passage 301, thereby in turn raising the pressure of fuel in the chamber 27 (see FIG. 1) in approximate proportion to the engine speed (RPM) as shown by the curve E in FIG. 10. The control unit 210 operates the motor 53 normally (see FIG. 1). The fuel injection pump, therefore, supplies the engine with a certain amount of fuel corresponding to the power required from the engine.

When the emergency switch 61 is opened in the emergency condition where, for example, the control unit 210 is out of order, the control unit 210 is deenergized to be at rest and the emergency valve 300 is also de-energized to close the fuel passage 216. Thus, fuel is supplied from the fuel tank 203 to the feed pump 23 only through the auxiliary passage 301. The rate of fuel flow through the passage 301 is restricted by the orifice 306, so that the pressure of fuel in the chamber 27 is roughly maintained at a relatively small value irrespectively of the engine speed (RPM) or the rotational speed of the feed pump 23 as shown by the broken curve K in FIG. 10. As a result, the amount of fuel supplied into the high pressure chamber 41 (see FIG. 1) in each intake stroke of the plunger pump, namely the amount of fuel injected into the engine cylinders in each discharge stroke of the plunger pump, decreases rapidly with increases in the engine speed (RPM) as shown by the curve J in FIG. 11. This causes the engine to remain operating at a preset speed at which the vehicle can be driven but prevented from running away in a manner similar to that of the previous third embodiment. This preset speed of the engine depends on the cross-sectional area of the restriction 306 determining the rate of fuel flow through the auxiliary passage 301.

Figure 17:
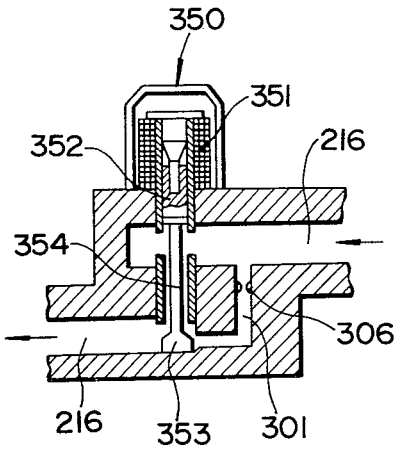
FIG. 17 is a diagrammatic sectional view of a pertinent portion of a seventh embodiment according to the present invention.
Figure 18:
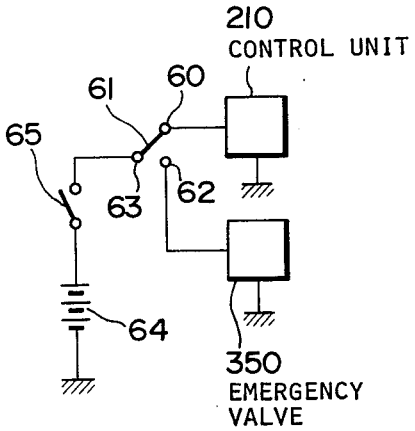
FIG. 18 is a schematic diagram of a circuit for operating the emergency vlave of FIG. 17.

The essential portion of a seventh embodiment of the present invention is shown in FIG. 17, arranged in a manner similar to that of the previous sixth embodiment except for the following design change. An electrically-driven emergency valve 350 disposed in a fuel passage 216 is so arranged as to close the fuel passage 216 when energized. The emergency valve 350 has a solenoid 351, a slidable magnetic member 352, a cone-shaped valve member 353 secured to the magnetic member by means of a stem 354, and a spring (not designated) urging the magnetic member 352 in the direction of opening the valve member 353. When the solenoid 351 is energized, the valve member 353 along with the magnetic member 352 is displaced against the force of the spring from its open position to its closed position. As illustrated in FIG. 18, the emergency valve 350, a control unit 210, an emergency switch 61, an engine key switch 65, and a battery 64 form a circuit similar to that shown in FIG. 9.

Under normal conditions, the movable contact 63 of the emergency switch 61 contacts the first stationary contact 60 thereof to supply electric energy to the control unit 210 to operate the same, provided that the engine switch 65 is closed. When the emergency switch 61 is changed to connect its movable contact 63 with its second stationary contact 62 in the emergency condition, the control unit 210 is de-energized to be at rest while the emergency valve 350 is energized to close the fuel passage 216. Since the emergency valve 350 is energized only during the emergency condition, the consumption of electric energy is lower than that in the circuit of FIG. 16.

Figure 19:
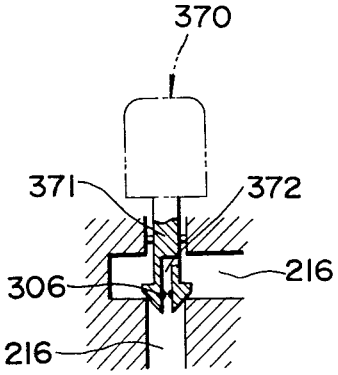
FIG. 19 is a diagrammatic sectional view of a pertinent portion of an eighth embodiment according to the present invention. Throughout all of the drawings, corresponding or similar elements are designated by the same numerals.

The essential portion of an eighth embodiment of the present invention is shown in FIG. 19, designed in a manner similar to that of the previous sixth embodiment except for the following design change. An emergency valve 370 interposed in a fuel passage 216 has a valve member 371 provided therein with an auxiliary passage 372. Both ends of the passage 372 open to the fuel passage 216 through the end and the side of the valve member 371 respectively so that the passage 372 will bypass the valve member 371 when it is closed. Thus the auxiliary passage 372 operates similarly to the auxiliary passage 301 of FIG. 15. A restriction or an orifice 306 is arranged in the auxiliary passage 372. This embodiment can be fabricated more compactly than the previous sixth embodiment.

When the emergency valve 370 is energized, the valve member 371 opens the fuel passage 216, thereby allowing fuel to pass through both the passages 216 and 372. When the emergency valve 370 is de-energized, the valve member 371 closes the fuel passage 216, thereby allowing fuel to pass through only the auxiliary passage 372, thereby reducing the flow rate of fuel supplied to the feed pump 23 and thus the high pressure chamber 41 (see FIG. 1).

The emergency valve 300, 350, or 370 and the orifice 306 in the auxiliary passage 301 or 372 of the sixth, seventh, or eighth embodiment may be located at any position along the fuel passage 216 from the fuel tank 203 to the feed pump 23 where the emergency valve or orifice can be attached most conveniently. The cross-sectional area of the orifice 306 is determined according to the effective length of the fuel passage 216 from the feed pump 23 to the orifice 306 or the emergency valve. It should be noted that the emergency switch 61 may be operated by the control unit 210 so as to be turned automatically and immediately when a problem occurs causing the control unit to go out of order. It should be understood that further modifications and variations may be made in the present invention without departing from the spirit and scope of the present invention as set forth in the appended claims.

What is claimed is:

1. A fuel injection pump for a diesel engine, comprising:

(a) a fuel tank for containing fuel;

(b) a housing defining a chamber;

(c) a fuel passage interconnecting the fuel tank and the chamber;

(d) a feed pump located along the fuel passage for driving fuel from the fuel tank toward the chamber;

(e) a plunger pump connected to the chamber for supplying fuel from the chamber to the engine;

(f) an overflow passage having one end connected to the chamber and the other end connected to the fuel tank for returning a part of fuel from the chamber to the fuel tank;

(g) a fuel return passage having one end connected to the chamber and the other end connected to the fuel tank for returning a part of fuel from the chamber to the fuel tank; and (h) an emergency valve interposed in the fuel return passage for selectively closing and opening the fuel return passage to reduce the rate of fuel supply to the engine when the emergency valve opens the fuel return passage.

2. A fuel injection pump as recited in claim 1, further comprising a restriction disposed in the overflow passage.

3. A fuel injection pump as recited in claim 1, further comprising a regulating valve located in the fuel return passage for regulating the pressure of fuel upstream thereof at an approximately constant level.

4. A fuel injection pump for a diesel engine, comprising:

(a) a plunger pump for supplying fuel to the engine;

(b) a fuel tank;

(c) a fuel passage having one end connected to the fuel tank and at the other end connected to the plunger pump;

(d) a feed pump located along the fuel passage for driving fuel from the fuel tank toward the plunger pump;

(e) a fuel return passage having one end connected to the fuel passage downstream of the feed pump and the other end connected to the fuel tank;

(f) an electrically-driven emergency valve interposed in the fuel return passage for blocking the fuel return passage when the emergency valve is electrically de-energized and opening the fuel return passage when the emergency valve is electrically energized;

(g) means, associated with the plunger pump, for adjustably determining the rate of fuel supply to the engine;

(h) an electrically-powered control unit for adjusting the rate-determining means;

(i) an emergency switch; and (j) an electrical power source electrically connected via the emergency switch to the emergency valve and the control unit;

(k) the emergency switch being changeable between a normal position and an emergency position, the electrical connection between the power source and the control unit being established to electrically activate the control unit when the emergency switch is in the normal position, the electrical connection between the power source and the control unit being blocked to electrically de-activate the control unit when the emergency switch is in the emergency position, the electrical connection between the power source and the emergency valve being established to open the emergency valve when the emergency switch is in the emergency position, the electrical connection between the power source and the emergency valve being blocked to close the emergency valve when the emergency switch is in the normal position.

5. A fuel injection pump as recited in claim 4, wherein the emergency switch comprises a movable contact, and first and second stationary contacts, the movable contact switchably contacting any one of the stationary contacts, the movable contact being electrically connected to the power source, the first stationary contact being electrically connected to the control unit, the second stationary contact being electrically connected to the emergency valve.

6. A fuel injection pump as recited in claim 4, further comprising a regulating valve located in the fuel return passage for regulating the pressure of fuel upstream thereof at an approximately constant level.

* * * * *